US008948425B2

(12) United States Patent
Hou et al.

(10) Patent No.: US 8,948,425 B2
(45) Date of Patent: Feb. 3, 2015

(54) METHOD AND APPARATUS FOR IN-SITU TESTING, FITTING AND VERIFICATION OF HEARING AND HEARING AIDS

(75) Inventors: Zezhang Hou, Cupertino, CA (US); Leon Aleksander Lindsey, Newcastle Upon Tyne (GB)

(73) Assignee: Ototronix, LLC, Houston, TX (US)

( * ) Notice: Subject to any disclaimer, the term of this patent is extended or adjusted under 35 U.S.C. 154(b) by 198 days.

(21) Appl. No.: 13/291,511

(22) Filed: Nov. 8, 2011

(65) Prior Publication Data

US 2012/0177212 A1 Jul. 12, 2012

Related U.S. Application Data

(63) Continuation-in-part of application No. PCT/US2010/001389, filed on May 11, 2010.

(60) Provisional application No. 61/215,786, filed on May 11, 2009.

(51) Int. Cl.
*H04R 25/00* (2006.01)

(52) U.S. Cl.
CPC ..... *H04R 25/70* (2013.01)
USPC ..... 381/312; 381/314

(58) Field of Classification Search
CPC ..... H04R 25/30; H04R 25/70
USPC ..... 381/60, 107, 312, 314, 31, 316, 5
See application file for complete search history.

(56) References Cited

U.S. PATENT DOCUMENTS

| | | | | |
|---|---|---|---|---|
| 5,822,442 | A * | 10/1998 | Agnew et al. | 381/107 |
| 6,118,877 | A * | 9/2000 | Lindemann et al. | 381/60 |
| 6,879,692 | B2 | 4/2005 | Nielsen et al. | |
| 7,016,504 | B1 * | 3/2006 | Shennib | 381/60 |
| 7,715,571 | B2 | 5/2010 | Boretzki et al. | |
| 2007/0223752 | A1 | 9/2007 | Boretzki et al. | |
| 2008/0273726 | A1 | 11/2008 | Yoo et al. | |

OTHER PUBLICATIONS

Neuman, Arlene C., Digital technology and clinical practice: The outlook for the future, Journal of Rehabilitation Research and Development, vol. 24 No. 4, pp. 1-6, Fall 1987.

Yost, W. et al., Encyclopedia of Acoustics, pp. 1545-1554, John Wiley and Sons, Inc. 1997.

* cited by examiner

*Primary Examiner* — Vivian Chin
*Assistant Examiner* — Ammar Hamid
(74) *Attorney, Agent, or Firm* — Marshall & Melhorn, LLC

(57) ABSTRACT

An improved multi-function hearing aid having in-situ testing, fitting and verification functions is disclosed which solves problems long standing in the art of hearing aid fitting dealing with individual size differences in the size of the pina and ear canal of the user, individual preference to sound level and frequency variation, and verification procedures.

27 Claims, 10 Drawing Sheets

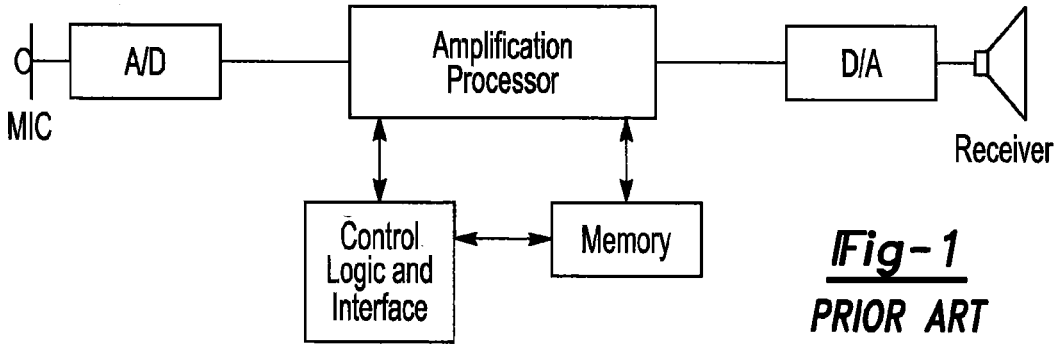
Fig-1
PRIOR ART
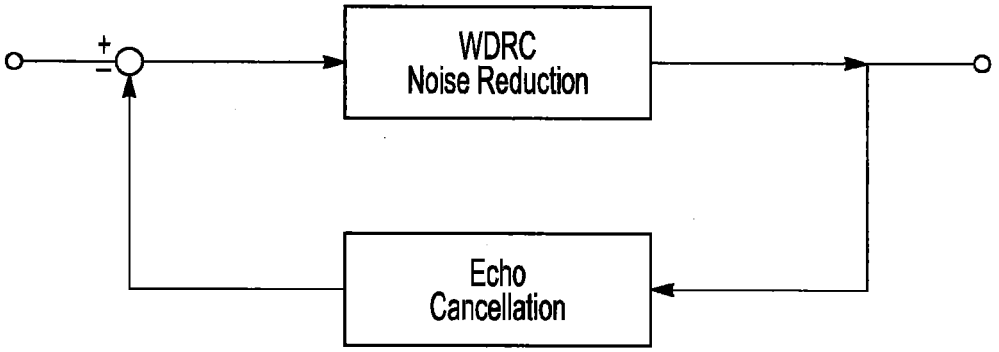
Fig-2
PRIOR ART
| Freq. (Hz) | FF (dB SPL) | ADC unit |
|---|---|---|
| 250 | 105 | 1 |
| 500 | 105 | 1 |
| 1000 | 104 | 1 |
| 2000 | 103 | 1 |
| 4000 | 102 | 1 |
| 6000 | 102 | 1 |
Fig-10

METHOD AND APPARATUS FOR IN-SITU TESTING, FITTING AND VERIFICATION OF HEARING AND HEARING AIDS

BACKGROUND OF THE INVENTION

This application is a continuation of Patent Cooperation Treaty application Serial No. PCT/US2010/001389, filed on May 11, 2010, which claims priority from provisional application Ser. No. 61/215,786, filed May 11, 2009 under 35 U.S.C. §111(b). Both applications are hereby incorporated by reference in their entirety.

FIELD OF THE INVENTION

The present invention relates to a method of testing hearing, hearing tests, hearing aid operation, hearing aid fitting, and fitting verification.

DESCRIPTION OF THE RELATED ARTS

It is well known that a hearing aid with flat frequency response, when worn in or behind the ear, does not produce a flat insertion gain for a user. For an average user, the correction needed for hearing aid response in order to produce a flat insertion gain can be achieved by the so-called CORFIG (COupler Response for Flat Insertion Gain). However, this correction does not consider the individual size differences of the pina and ear canal. These differences may demand different gain setting for the user, and if not considered, may result in less accurate fitting.

Almost all fitting formulae for hearing aids are prescribed assuming the user has an average size of body, ear, and ear canal. The individual size difference of the pina and canal is not taken into account, largely due to technical difficulty. The difference may have little effect on hearing aid fitting if the fitting process involves an interactive guess-and-check procedure until the user is satisfied with the settings. The fitting may be less accurate if such interactive procedure is not employed. Some fitting protocols try to verify if the average target is achieved with a real ear measurement. However, this kind of verification may actually be misleading when the user has significant size difference in the pina and canal from the average.

Another factor that can affect the accuracy of hearing aid fitting is the procedure for the hearing test itself. An individual's hearing is measured against the hearing level of the normal average, and the measurement equipment is usually calibrated for the average listener. When hearing is measured using a headphone or an insert earphone, the effect of the individual size difference of pina and canal is again ignored.

The in-situ hearing test with the testing sounds delivered by the hearing aid receiver has been proposed and used to overcome the above mentioned problems. However, the existing arts in this area are about obtaining the more accurate evaluation about patients hearing loss and hearing aid response. With regard to how use the more accurate evaluation to derive the hearing aid gain, the existing approach is still to use the prescription statistically derived for the average user.

Another problem in hearing aid fitting is that individual listening preference to sound level and frequency equalization are not taken into considerations in fitting formulae and the real ear verification procedures.

In many situations, it is required to conduct aided functional gain measurement to verify the performance of the hearing aids. The problem is that aided functional gain measurement has to be done by the free field with testing sounds delivered to both ears simultaneously. The measurement is useful in evaluating the overall performance of both hearing aids. However, it is sometimes difficult to determine which of the two hearing aids is providing more benefit.

From the foregoing, it can be seen that there are still longstanding problems in the field of hearing devices and procedures for hearing aid fitting that those with skill in the art have been unable to solve.

SUMMARY OF THE INVENTION

The present invention relates to improved approaches to hearing tests, hearing aid design, hearing aid fitting and fitting verification. In one embodiment of the invention, an improved method of testing hearing is disclosed.

In another embodiment of the invention, a multifunction hearing aid is operated in accordance with the method of the present invention to provide a hearing with in-situ hearing testing, in-situ hearing aid fitting, and fitting verification.

Such a hearing aid may include:

At least one microphone and one receiver;

A digital signal generator that generates digital stimuli for the in-situ measurement of a user's hearing profile, such as in-situ threshold hearing level (THL), in-situ uncomfortable level (UCL), and/or in-situ most comfortable level (MCL). The level of the stimuli is calibrated against the levels of the AD unit in response to the free field sound at the levels of the THL, UCL, and/or the MCL for normal hearing listeners. The calibration is carried out for an average head.

Amplification processor circuit or software for processing sounds picked up by microphone or the test stimuli generated by the digital signal generator;

Control logic/interface that can be used to connect a second computing device to control and program the signal generator and amplification processor circuit/software;

A mode control switch that controls the working mode of the multifunction hearing aid. Under the hearing aid mode, the sounds picked up by the microphone are fed directly to the amplification processor circuit. Under the in-situ testing/fitting mode, the signal generator is connected to the amplification processor circuit and the D/A converter.

When the multifunction hearing aid is set to the hearing aid mode, it processes the sounds picked up by the microphone to compensate for a user's hearing loss.

When the multifunction hearing aid is set to in-situ testing/fitting mode, (a) In one embodiment, the parameters of the amplification processor circuit are adjusted by the external computing device to obtain a target in-situ hearing profile. With one embodiment, at least one parameter of the amplification processor is adjusted in-situ until the normalized test stimuli corresponding to the MCL are comfortable for the user. Another amplification processor parameter is adjusted in-situ until the normalized test stimuli corresponding to the UCL are just uncomfortable to the user.

(b) In another embodiment, the level of the test stimuli is manipulated directly by the external computing device so that the unaided in-situ hearing profile is obtained; and hearing aid parameters are derived from the unaided in-situ hearing profile, and optionally, the aided in-situ hearing profile is obtained to verify that the derived hearing aid parameters make the user hear better.

The invention makes it possible to precisely obtain hearing aid parameters for a user by factorizing the individual ear size into the fitting procedure. It has the potential to maximize the hearing aid performance for the user. Also, it makes it possible to fit a hearing aid without a separate test with separate equipment, such as a stand-alone audiometer or real-ear measurement system. Other aspects and advantage of the invention will become apparent from the following detailed description taken in conjunction with the accompanying drawings which illustrate, by way of example, the principle of the invention.

BRIEF DESCRIPTION OF DRAWINGS

The invention will be readily understood by the following detailed descriptions in conjunction with the accompanying drawings, wherein like reference numerals designate like structural elements in the several views.

FIG. 1 is a schematic of a typical prior art digital hearing aid system.

FIG. 2 is a schematic diagram of a typical prior art amplification processor.

FIG. 10 is a calibration table used in the method of the present invention.

DETAILED DESCRIPTION OF THE PREFERRED EMBODIMENTS

Figure 3:
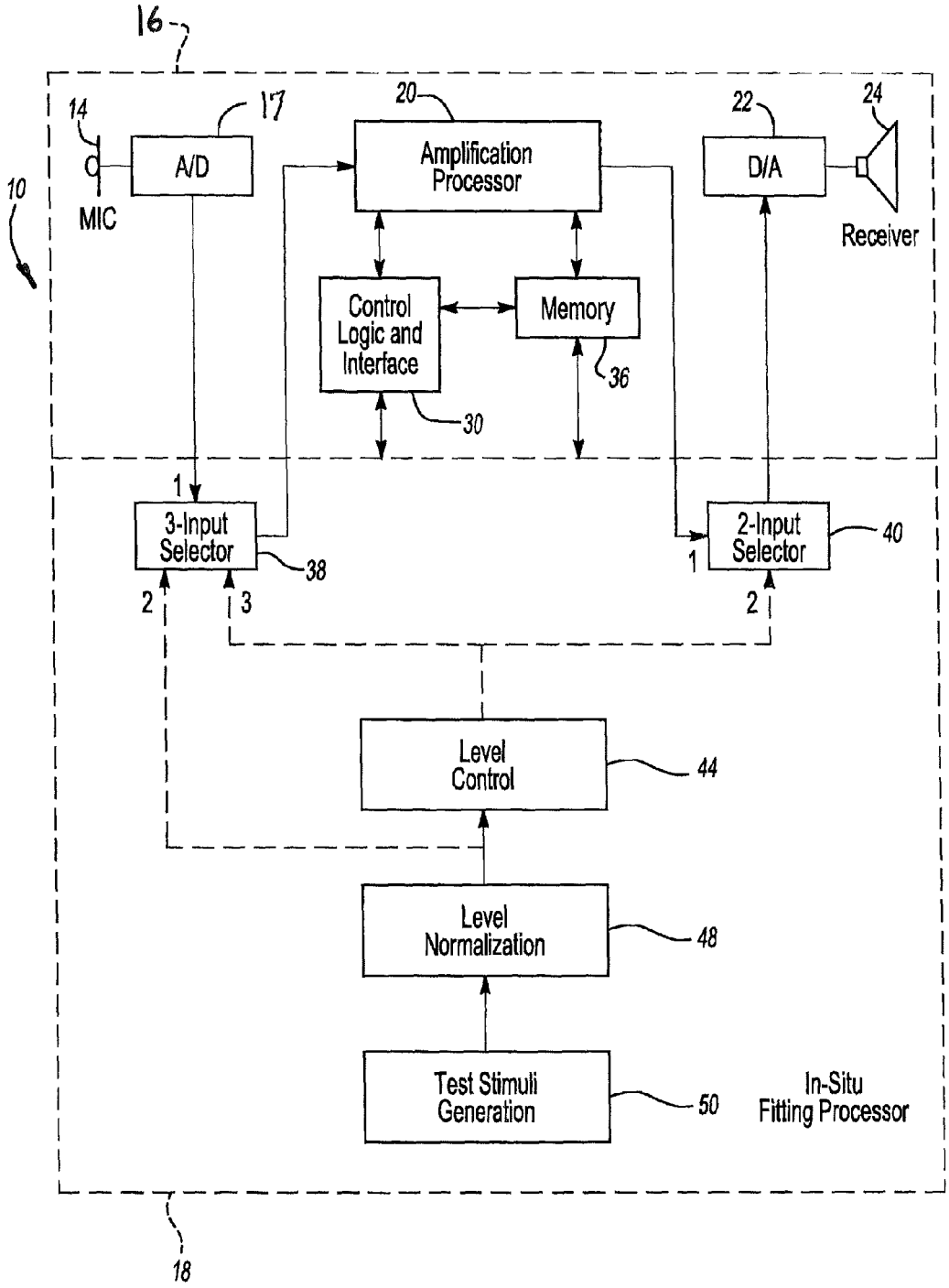
FIG. 3 shows a schematic diagram of a hearing aid configured in in accordance with one preferred embodiment of the present invention. It includes two parts, a normal amplification processor and an in-situ fitting processor.

As known in the art, a microphone is an acoustic-to-electric transducer or sensor that converts sound into an electrical signal. Most microphones today use electromagnetic induction, piezoelectric generation, or light modulation, to produce an electrical voltage signal from mechanical vibration. While any of these types of microphones may be used in the present invention, a condenser microphone is preferred.

For a given sound input, most usually measured in decibels (dB), a microphone manufacturer will know the electrical signal produced thereby, normally in the millivolt (mV) range. This value is sometimes, when converted into digital units via an analog to digital converter, referred to in the art in terms of ADC units per Pascal. Because most microphones are calibrated to tight standards, for a given ADC unit, the sound pressure (SP) in decibels will be known to ±3 dB.

The present invention not only uses this property, but does so in a novel and unique way to provide an improved method of testing hearing, as well as a hearing aid operated in accordance with this unique and novel method to have in situ testing, fitting, and verification, all while taking into account differences in the individual size of the pina and ear canal of the hearing a user.

FIG. 1 is a schematic diagram of a typical prior art digital hearing aid system. The microphone (MIC) picks up sound and converts it into electronic analog signals. The A/D converter converts the analog signals into digital signals. Digital signal processing (DSP) circuit/software processes the digital signals to filter out unwanted components and amplify the wanted components to compensate for hearing loss.

A typical prior art amplification processor is shown in FIG. 2. The D/A converter converts the processed digital signals back to the analog signals. Finally, the receiver converts the processed analog signals into the amplified sounds. The parameters of the amplification processor can be set manually or by another device (such as a computer) via control logical/interface. The selected parameters can also be saved and retrieved in the memory.

The microphone shown in FIG. 1 produces an electrical signal based on the input of sound into the microphone. However nothing further is done with this electrical signal except to process it in ways known in the art, and then convert the electrical signal back to an analog signal and feed it to the hearing aid receiver in the form of sound which is heard by the hearing aid user. In the hearing aid art, the term "receiver" refers to a hearing aid speaker.

The conventional hearing aid of FIG. 1 may use the circuitry shown in FIG. 2, which is known in the art, to perform various operations on the signal from the microphone before it is used to produce a sound in the hearing aid receiver. However, the usefulness of the electrical signal from the microphone, in relationship to the sound input in decibels is not fully utilized to calculate the insertion gain needed by the user. Instead the hearing aid fitter, even if using an in-situ fitting process, must make time consuming tests and manual adjustments to a hearing aid to fit it properly.

In contrast, the method of the present invention, by using the calibration of the hearing aid microphone to determine the insertion gain, and then causing a hearing aid to operate according to the method of the present invention to automatically perform several well known hearing tests in-situ, which may be the threshold hearing level (THL) tests, most comfortable level (MCL) test, and the uncomfortable level test (UCL), in situ tests may be quickly and easily performed by the hearing aid fitter. After mapping of the tests, hearing aid fitting and fitting verification can take place.

With reference to FIG. 3, there is shown a schematic diagram of a fully programmable multi-function hearing aid configured in accordance with the method of the present invention, generally designated by the numeral 10. In one preferred embodiment of the current invention. It includes two parts, a normal amplification processor 16, and in-situ fitting processor 18. The normal amplification processor 16 may be substantially similar to the prior art hearing aid devices shown on FIGS. 1 and 2, and have various functions. The signal from the microphone 14 can be processed to compensate for hearing loss, remove unwanted noise and echoes, and utilize algorithms such as multi-channel wide dynamic range compression (WDRC) and noise reduction, multi-microphone directional processing, and echo cancellation by means well known in the art. The parameters for WDRC and other algorithms can be set according to a user's hearing loss profile, ear anatomy, and preference. These parameters can be stored in the device memory. The adjustment of these parameters can be made from an external computer and programming device through the device control logic or interface. The device control logic or interface can be a standard state machine known in the art such as an IIC protocol.

Only one processor can be selected at a time. The selection is also controlled by control logic or by another device (e.g., a computer) through control interface/logic 30, which is known in the hearing aid art.

Normally, the hearing aid 10 works under the normal amplification mode so that the input sound is processed to compensate for hearing loss. For each decibel level of sound entering the microphone 14 a corresponding level of electrical signal or ADC units is produced. It may be desirable to perform a calibration test on the particular microphone 14 in the hearing aid 10 being calibrated so as to take in to account natural variations between microphones. However, this is optional, due to the aforementioned tight manufacturing standards.

As a first step in one of the preferred embodiments of the present invention the hearing aid 10 may be programmed with ADC values representing the free field level at the threshold hearing of the normal person for any desired frequencies. This may be done in reference to ANSI Standard 3.5, or other standards known in the art. Different standards may be used for different age groups of hearing aid users. A mapping may be made of sound level versus ADC units if desired. The programming may also be done after the aid is fitted to the user, but having this programmed first is the preferred embodiment.

Next, the hearing aid 10 will be fitted to the intended user of the hearing aid. A THL test will be performed by the hearing aid fitter, with the potential user wearing the hearing aid to be fitted. Standard test tones, which may be those known in the art, are generated by the hearing aid 10. When the generated test tone at any particular frequency is just barely audible to the user, the output of the aid in ADC units is recorded. The ratio of ADC units at the THL, with the ADC units of the normal user at a particular frequency is the gain for that particular user at the particular frequency.

If S is the measured free field sensitivity of the hearing aid microphone in ADC units/Pascal, and F is the desired free field sound pressure in Pascals of a person with normal hearing at any desired frequency and sensation level, and T is the measured level in ADC units in the aided patient at any desired frequency and sensation level, the gain G which must be applied at any desired frequency, to correctly transform F so that is correctly perceived can be expressed by the formula $G=T/SF$. The wearer of the hearing aid will hear a sound as would a person with normal hearing at that sensation level if the hearing aid applies a linear gain of G to any particular sound.

In a hearing aid, thresholds are measured using signals generated by a hearing aid and attached computer interface which correspond to the digital amplitude coefficient of the sine wave heard at threshold. For simplicity, for most applications it is preferred to consider this a linear value.

If the desired test is a test for the most comfortable level (MCL), the test stimuli are conditioned to represent the stimulus ADC units of the hearing aid required to meet the criterion for MCL for normal listeners. If the desired test is a test for the un-comfortable level (UCL), the test stimuli are conditioned to represent the ADC units of the hearing aid required to meet the criterion for UCL. (Box 160).

In order for these tests to be given, the method of the present invention will cause the hearing aid 10 to be configured in several ways, the normal amplification mode described above, the in-situ testing or fitting mode, the integrated fitting configuration, the fitting verification configuration, and the fitting verification configuration. These can be understood by referring to FIGS. 3-7.

Figure 4:
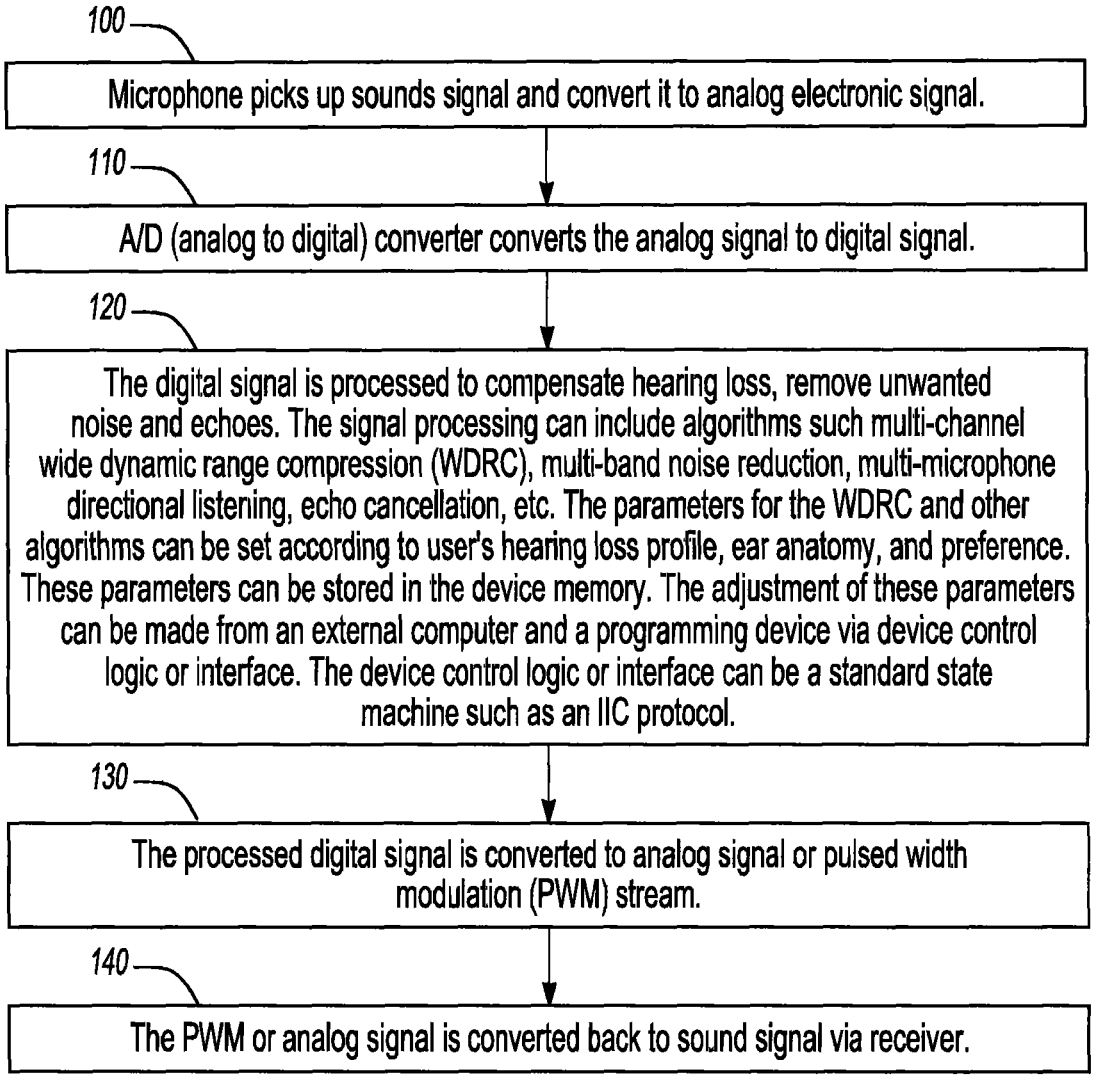
FIG. 4 is a flow chart showing the steps the hearing aid of FIG. 3 performs when configured in the normal amplification mode.
Figure 5:
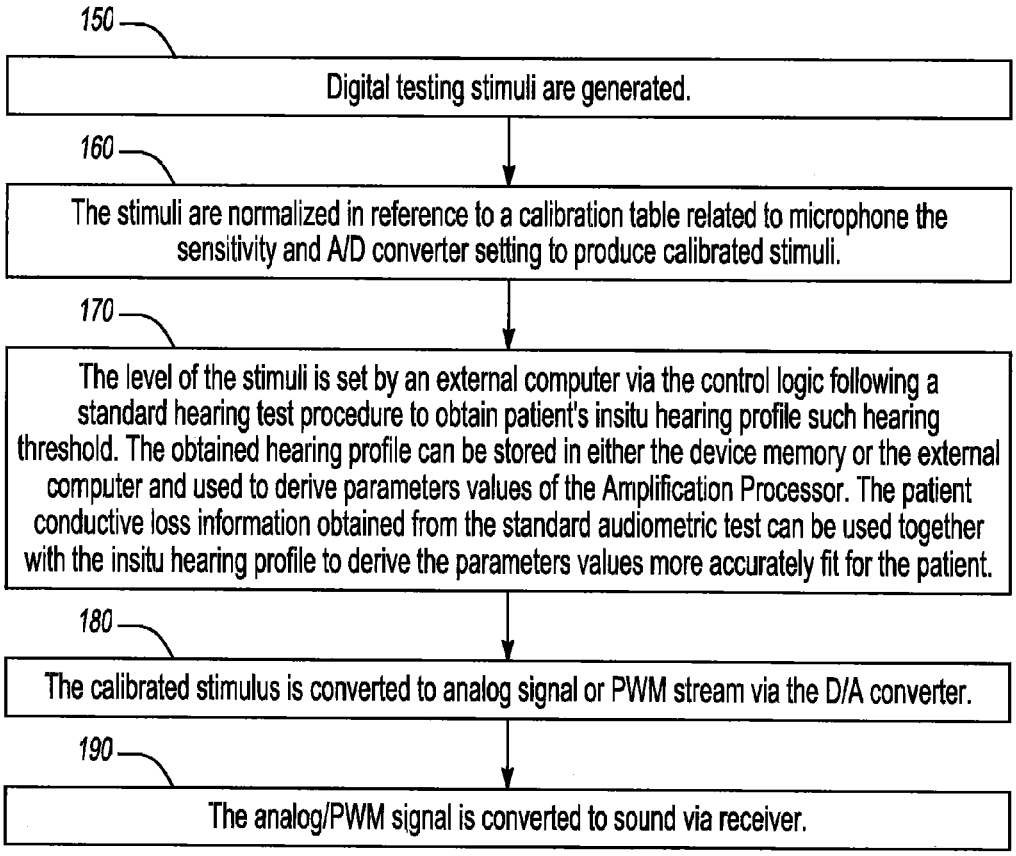
FIG. 5 is a flow chart showing the steps hearing aid FIG. 3 performs when configured in the in situ testing or fitting mode.

With reference to FIGS. 3 and 4, when the normal amplification mode is selected, the sounds picked up the microphone 14 are output by the microphone as analog electronic signals (Box 100).

The analog electronic signals from the microphone 14 are converted into digital signals by A/D converter 17 (Box 110).

The 3-input selector 38 passes the signals to the amplification processor 20, where the signals are processed to compensate for hearing loss (Box 120).

The output of the amplification processor 20 is selected by the 2-input selector 40 and converted to analog signals by the D/A converter 20 (Box 130). The analog signals are converted into sounds by the receiver 24 (Box 140). The sound delivered into the user's ear through the receiver 24 is, therefore, an amplified version of the sound picked by the microphone 14.

When the in-situ testing/fitting mode is selected (FIG. 5), the hearing aid 10 functions as a testing, fitting and fitting verification device. With the control via another computing device such as a PC, the hearing aid generates test stimuli using test stimuli generator 50 (Box 150).

The test stimuli are then conditioned in such a way that they are equivalent to the ADC units of the hearing aid in response to the free field sound at the levels of a normal hearing profile (level normalization). In other words, the conditioned stimuli are effectively calibrated with the free field levels for the average head. For example, if the desired in-situ test is for the most comfortable hearing level (MCL), the test stimuli are conditioned to represent ADC units of the hearing aid in response to the free field sound at the minimum audible level for normal listeners. As explained hereinabove, this would involve applying a gain (G) determined by the hearing aid 10 at the MCL to the free field values of MCL.

The calibrated stimulus is then converted to an analog signal or PWM stream by the D/A converter 22 (Box 180), and the analog/PWM signal is converted to sound by the receiver 24 (Box 190).

While in the in-situ testing/fitting mode, the system can be further configured to do one of the following: unaided in-situ testing, aided in-situ testing (e.g., fitting verification), or integrated fitting.

When the system is configured for the unaided in-situ testing, the level of the normalized test stimuli is further controlled by an external computing device to obtain the intended hearing profile such as THL, MCL, or UCL via level control 44. The output of level control 44 is selected by 2-input selector 40 and sent to the D/A converter 22 and delivered to user's ear through the hearing aid receiver 24. Since the test is conducted with hearing aid in the place exactly how it will be worn by the user, the effect of the size of pina and ear canal, as well as hearing aid size and shape, are already considered in the results. Since the test stimuli are normalized, the results are effectively in reference to the free field sounds, which are the common reference for all people. The only factor that pertains to the general calibration of the average head is the microphone conversion of the free field sound levels to the digital representations of hearing aids, which has less variation than the size of pina and ear canal. Therefore, the underlined unaided in-situ test results are more accurate.

When the system is configured for the aided in-situ testing, the level of the normalized test stimuli (Box 150) is further controlled by an external computing device to obtain the intended aided hearing profile such as hearing threshold, MCL, or UCL (Box 160).

The output of level control 44 is selected by 3-input selector 38 (Box 170) and sent to the amplification processor 20 (Box 180) and delivered to user's ear through the D/A converter 22 and the receiver 24 (Box 190). Since the test is conducted with hearing aid in the place exactly how it will be worn by the user, the effect of the size of pina and ear canal, as well as hearing aid size and shape, are already taken into account in the results. Since the test stimuli are normalized, the aided results are effectively in reference to the free field sounds, which are the common reference for all people. The only factor that pertains to the general calibration of the average head is the microphone conversion of the free field sound levels to the digital representations of hearing aids, which has less variation than the size of pina and ear canal. Therefore, the underlined aided in-situ test results provide more accurate evaluation of the hearing aid performance.

Figure 6:
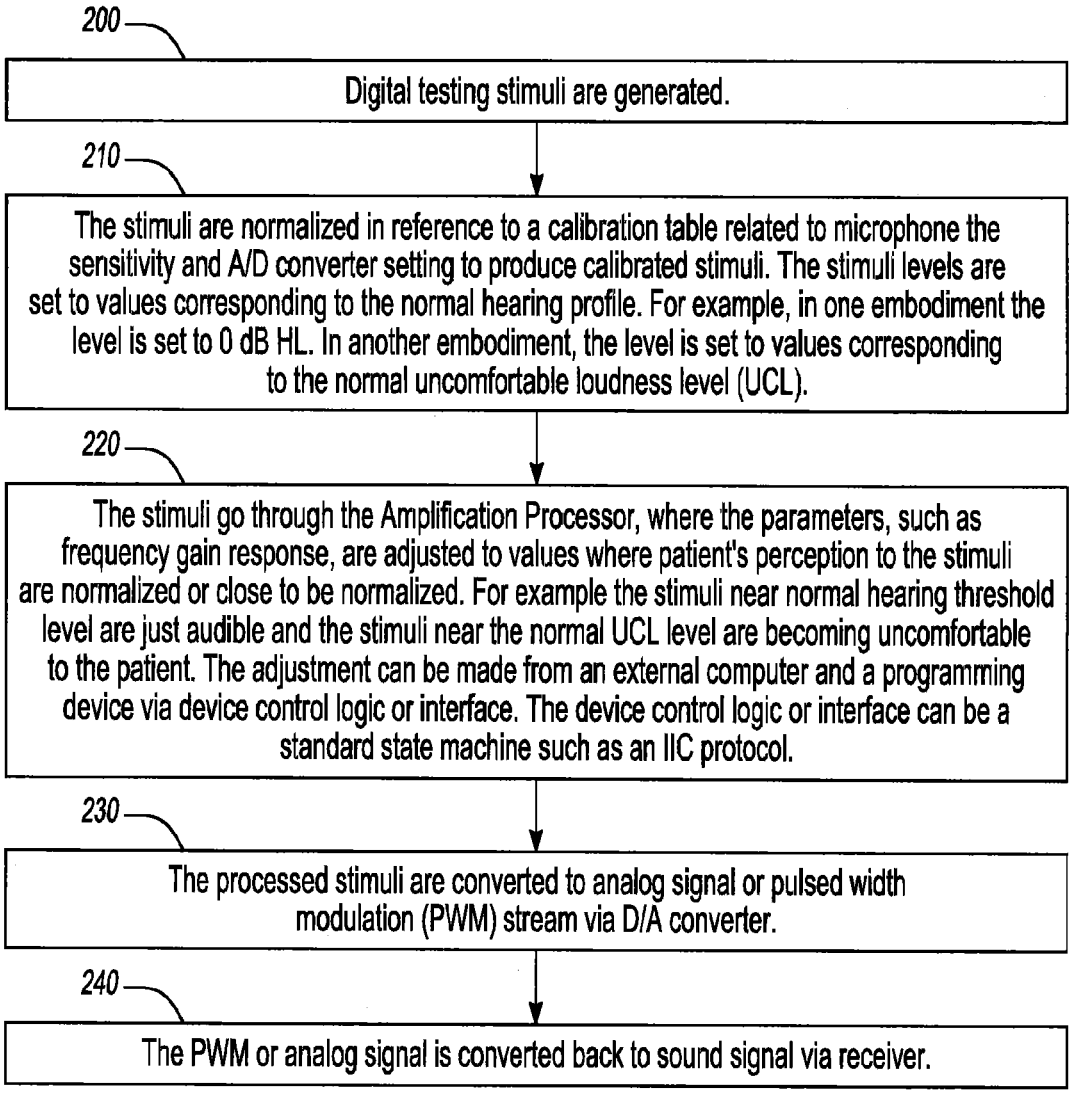
FIG. 6 is a flow chart showing the steps the hearing aid of FIG. 3 performs when configured in the integrated fitting configuration.

When the system is configured for the integrated fitting configuration, as shown in FIG. 6, the normalized test stimuli (Box 210) are connected to the input of amplification processor 20 (Box 220). The output of the amplification processor 20 is selected by 2-input selector 40 and delivered to user's ear through the D/A converter 22 (Box 230) and the receiver 24 (Box 240). The frequency gain of the amplification processor is adjusted by the external computing device via the control logic and Interface in such a way until the processed test stimuli sounds normal or close to normal for the user. For example, the frequency gain of the amplification processor may be adjusted until the normalized. MCL stimuli sound comfortable to the user and the normalized UCL stimuli sound just uncomfortable to the user. Since the adjustment is conducted with hearing aid 10 in place exactly how it will be worn by the user, the effect of the size of pina and ear canal, as well as hearing aid size and shape, are already considered in the results. Since the test stimuli used for the adjustment are normalized in reference to the free field level, which is the common reference for all people, the integrated fitting procedure allows the hearing aid user to achieve a normal hearing or close to the normal hearing for a wide range of real world sounds.

Figure 7:
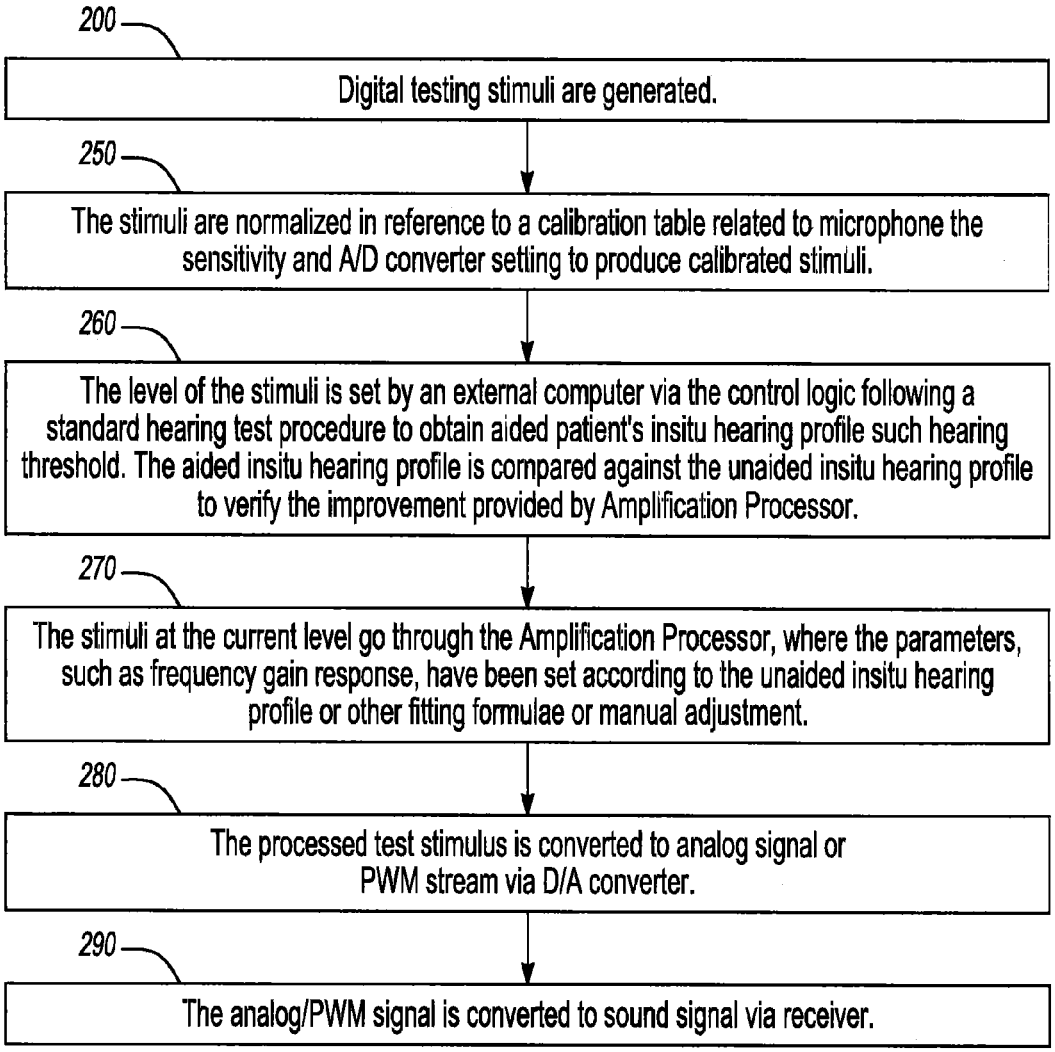
FIG. 7 is a flow chart showing the steps the hearing aid of FIG. 3 performs when configured in the fitting/verification configuration.

The steps used in the fitting verification configuration are illustrated in FIG. 7. Once again, digital testing stimuli are generated by means known in the art. The stimuli are normalized with reference to a calibration table (see FIG. 10) related to microphone sensitivity and the A/D converter setting to produce a calibrated stimuli (Box 250). If it is needed to generate a 1000 Hz tone at 64 dB SPL, which is 40 dB down from the reference sound field value in the table (104 dB SPL), one of ordinary skill in the art would know that the corresponding ADC unit will be 0.01 (−40 dB corresponding to a linear change of 0.01).

The calibration table may be generated by putting the hearing aid 10 in a sound field and reading the ADC units from the hearing aid chip into a computer. For example, if the sound field has a sound pressure level of 84 dB SPL at 1000 Hz, and the reading of the ADC units is 0.1, the calibration table for the 1000 Hz tone can be constructed as the one shown in the table of FIG. 10. Different microphones and ADC settings may require different calibration tables.

The level of the stimuli is set by an external computer via the control logic to obtain the aided patient's in situ hearing profile. (Box 260).

The stimuli at the current level go through the amplification processor 20 where the parameters have been set according to the unaided in situ hearing profile, other fitting formulae, or manual adjustment (Box 270).

The processed test stimuli are then converted to an analog signal or a PWM stream via the D/A converter 22 (Box 280). The analog/PWM signal is then converted to sound via the receiver 24.

Figure 7A:
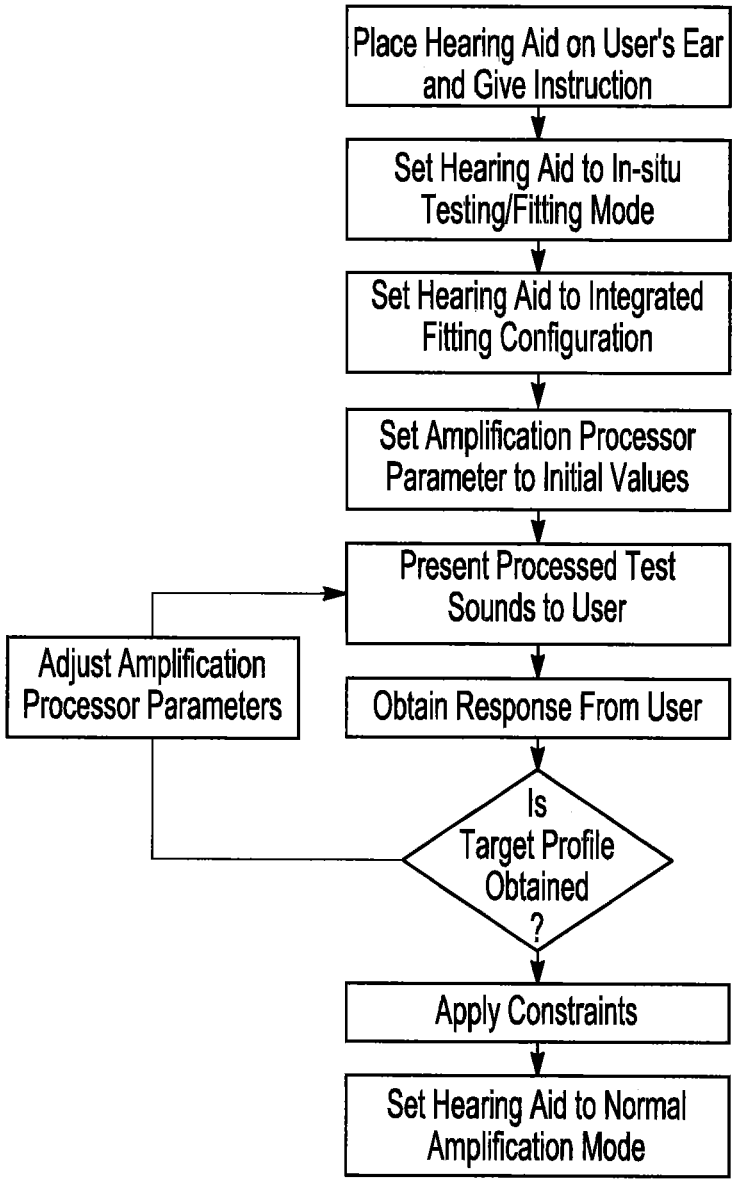
FIG. 7A is a flow chart showing the steps the hearing aid of FIG. 3 performs when configured in the fitting/verification configuration, with direct adjustment of the verification parameters.

A method in large part similar to that illustrated in FIG. 7, but with direct adjustment of the amplification parameters, is shown in FIG. 7A.

Figure 7B:
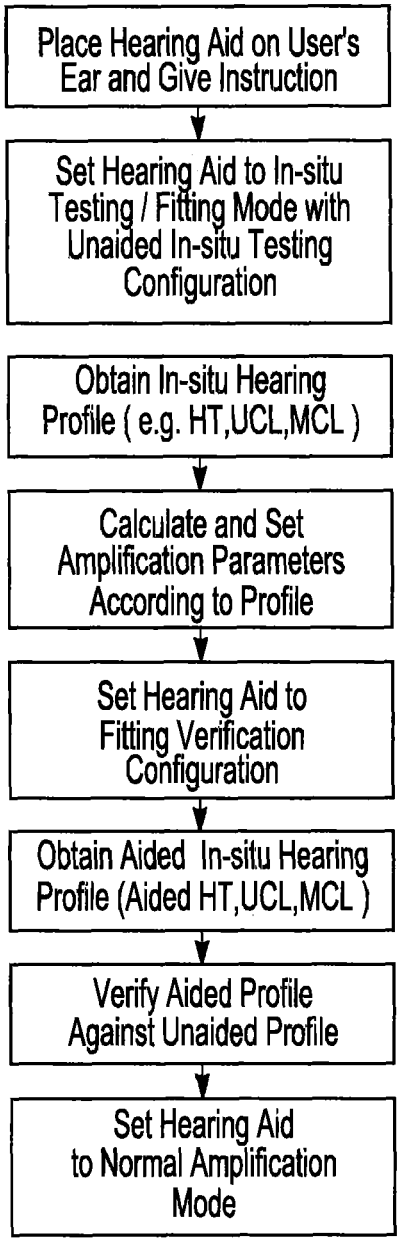
FIG. 7B is a flow chart showing the steps the hearing aid of FIG. 3 performs when configured in the fitting/verification configuration, with direct control of the stimuli level.

A method in large part similar to that illustrated in FIG. 7, but with direct adjustment of the stimuli level, is shown in FIG. 7B Having now illustrated how a hearing aid embodying the present invention operates in the normal amplification mode and in various in-situ testing and fitting modes, the method of the present invention can be understood.

Figure 8:
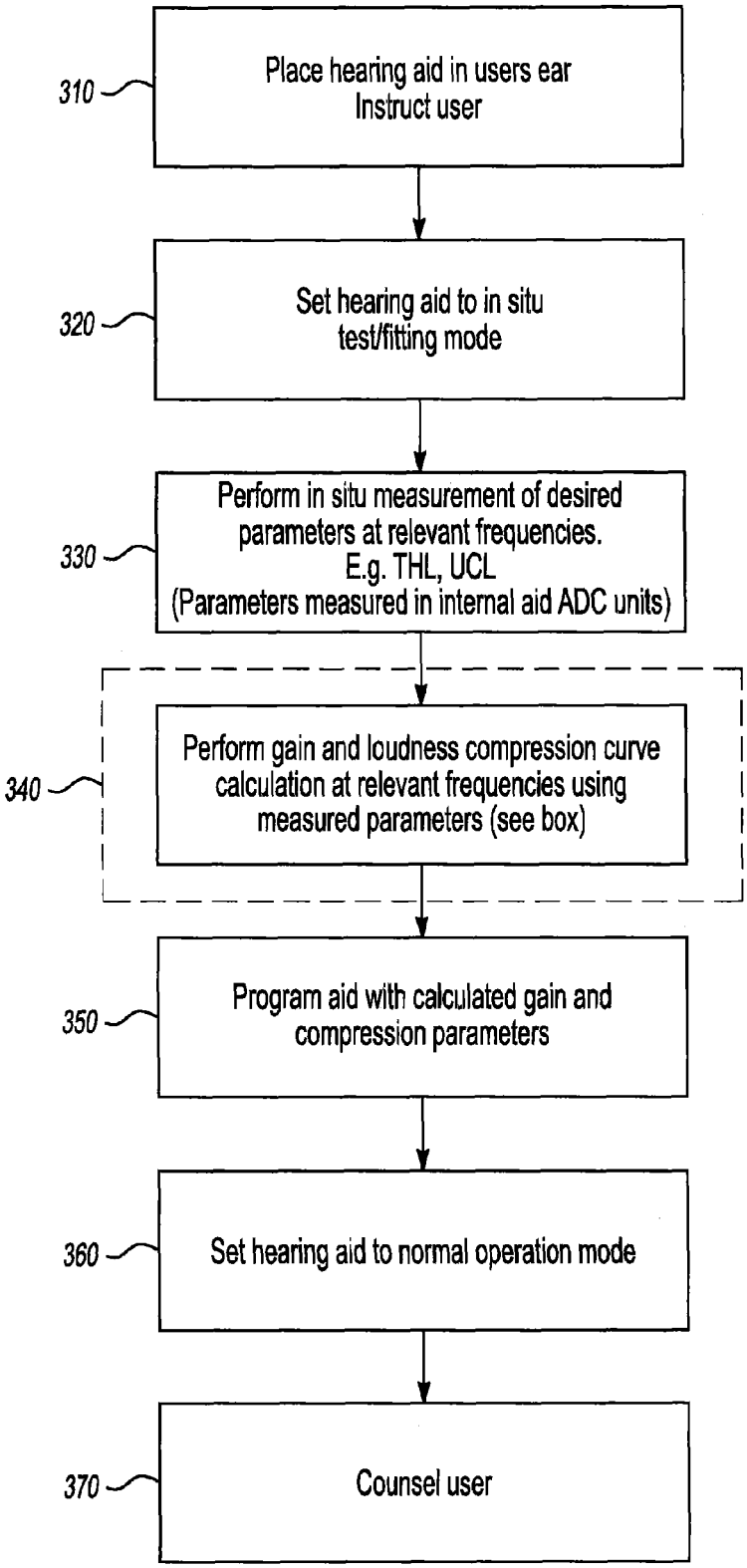
FIG. 8 is a flow chart illustrating the steps performed by by one preferred embodiment of the method of the present invention.

Referring to FIG. 8, the hearing aid 10 is placed in a user's ear exactly as it would be placed for everyday use (Box 310).

Next, the hearing aid 10 would be set to the in-situ test/fitting mode (Box 320). The hearing aid 10 would take the in situ measurement of desired parameters at relevant frequencies. The hearing aid would internally generate tones, and the user would be asked various questions concerning the tones. The tests may be the normal THL, MCL and UCL tests. In accordance with the present invention, the parameters would be measured in internal ADC units, or their equivalent (Box 330) at the desired parameters and frequencies.

The values in ADC units at the desired parameters and frequencies would be compared with the free field sound pressure at the same desired parameters and frequencies, and the gain for the particular user at each desired parameter and frequency would be calculated. (Box 340). Other calculations or operations may be performed based on these values, if desired, such as calculating a compression curve.

Once these values and calculations are made, the hearing aid 10 is programmed with the calculated values to run a desired program (Box 350). Once programmed, the hearing aid would be set to normal operation mode (Box 360) and the user would then be counseled in the use of the hearing aid (Box 370).

Figure 9:
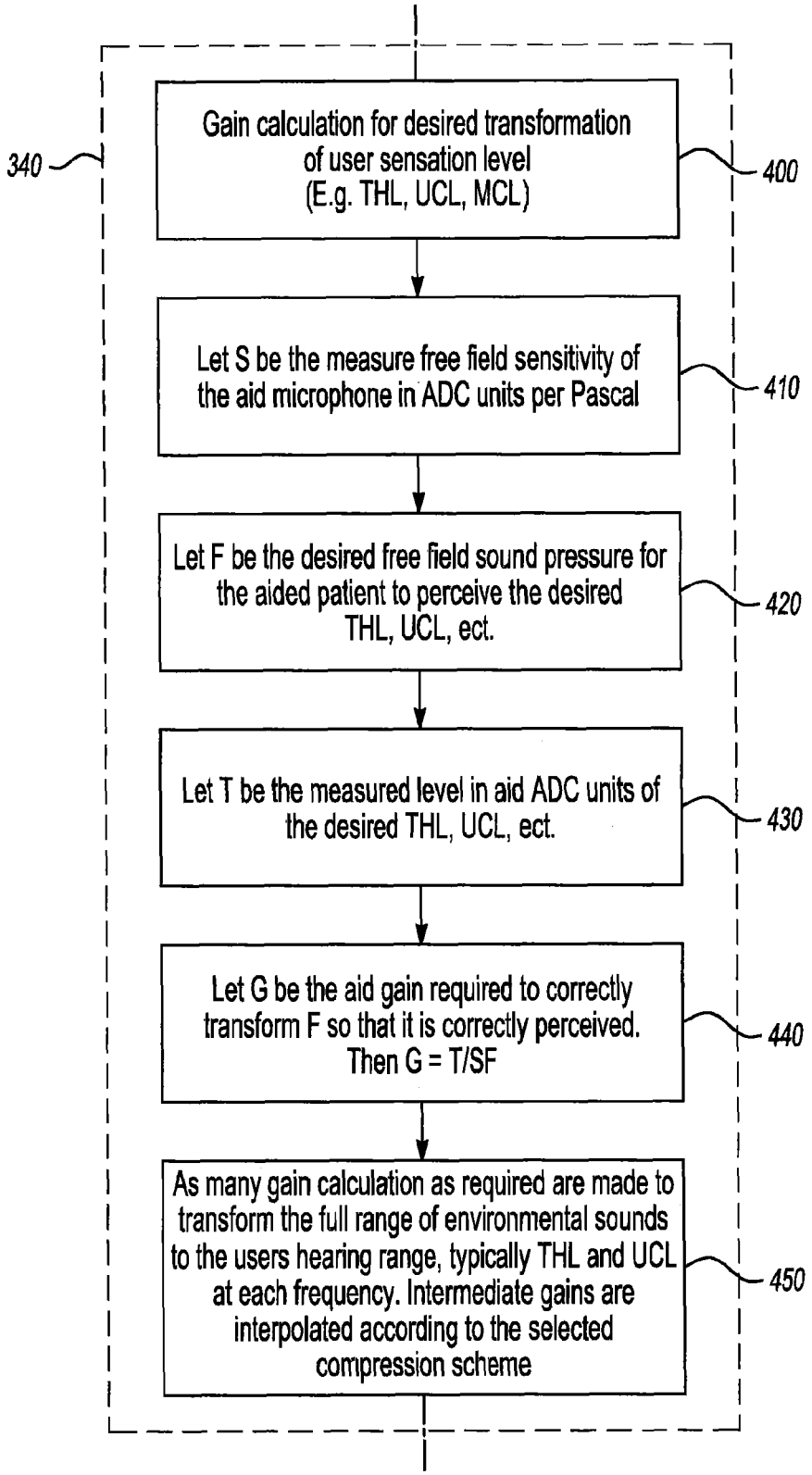
FIG. 9 is a flow chart further illustrating the step of performing the loudness and gain compression curve calculations.

Referring to FIG. 9, the steps used to perform the gain and loudness compression curve calculations are illustrated. The task (THL, MCL, UCL) for which the calculation is going to be made is first selected (Box 400). The free field sensitivity of the aid microphone 14 at the relevant frequencies for the measured parameters are inputted (Box 410). The gain G is then applied to all of the inputted values (Boxes 420-440) and as many gain calculations as required are made to transform the full range of environmental sounds to the users hearing range (Box 450). These are typically the MCL and/or the THL and/or the UCL at each frequency. Intermediate gains are interpolated according to a selected compression scheme, which is known in the art. Having these values, the hearing aid then calculates the gain and compression curves which will be used to program the hearing aid.

In a preferred embodiment of the invention, the method of the present invention is programmed to work with hearing aid chips that are capable of generating pure tones at various frequencies and levels, which may be such as the model No. Airo 5900, manufactured by On Semiconductor Corporation of Phoenix, Ariz.

It is clear that the novel method of the present invention will provide customized in-situ testing, fitting and verification of hearing aids without the use of earphones headphones or loudspeakers. A hearing aid operated in accordance with the method of the present invention will be able to, in one sitting with the aided user, and with the individual variations in the size of the ear canal and pina taken into account, determine individualized gains for the aided user at any desired parameters and frequencies, and use those individualized gains to provide for a better operation of the hearing aid than is currently available. Thus, by carefully considering the problems present in the art, a novel method and apparatus has been developed.

Since many features and advantages of the present invention are apparent from the written description, it is intended by the appended claims to cover all such features and advantages of the invention. Further, since numerous modifications and changes will readily occur to those skilled in the art, it is not desired to limit the invention to the exact method as illustrated and described. Hence, all suitable modifications and equivalents may be resorted to as falling within the scope of the invention.

We claim:

1. A method of fitting a hearing aid to a user based on microphone sensitivity and measured hearing level of the user, both with reference to the electrical output signal of the microphone or its equivalent, the method comprising:

a) for a sound at a particular frequency and level, passing the electrical output of the microphone through an analog to digital converter, and measuring the output of the analog-to-digital converter to obtain a value for the output in ADC units to obtain the microphone sensitivity S, whereas ADC referring to analog to digital converter;

b) measuring, for a particular frequency an in situ hearing level T in ADC units for a user, wherein the measuring is performed without the use of earphones, headphones, or loudspeakers: and c) determining for the user a gain, wherein the gain is calculated using the formula: Gain (G)=T/FS, where S is the measured free field sensitivity—of the microphone in ADC units/Pascal, or its equivalent, at the particular frequency, T is the in-situ hearing level and F is the desired free field sound pressure for a person with normal hearing to perceive a sound at the particular frequency.

2. The method defined in claim 1, further comprising the steps of:

a) applying the calculated gain to the microphone output at each desired frequency and parameter to correctly transform the full range of environmental sounds so that the user hears these sounds as closely as possible to the manner in which a normal person would hear the sound.

3. The method defined in claim 2, further comprising generating a range of sounds overlapping the user's hearing range at the threshold hearing level, most comfortable hearing level and uncomfortable hearing level.

4. The method defined in claim 3, further comprising testing the users hearing at the threshold hearing level, most comfortable hearing level and uncomfortable hearing level and measuring the hearing aid output T.

5. The method defined in claim 1 comprising the steps of:

a) measuring, for a sound at a particular frequency and level, the microphone output in ADC units, b) having a hearing aid fitter perform a threshold hearing level test on the person being fitted at the predetermined, desired frequencies and parameters using tones internally generated by the hearing aid;

c) determining the output of the hearing aid microphone in ADC units or its equivalent at each of the predetermined desired frequencies and parameters in the threshold hearing level test;

d) determining from the hearing aid microphone output the gain necessary at each of the predetermined, desired frequencies and parameters for the user of the hearing aid to hear at a normal threshold hearing level at each of the predetermined, desired frequencies and parameters;

e) calculating gain and loudness compression curves at the threshold hearing level and/or the, most comfortable hearing level and/or the uncomfortable hearing level and f) programming the hearing aid with a desired program for operation of the hearing aid, all while the hearing aid user is wearing the hearing aid, and without the use of earphones, headphones, or loudspeaker.

6. The method of fitting a hearing aid to a user defined in claim 5 in three separate steps, the method comprising:

a) in-situ hearing testing;

b) gain calculation as a function of frequency and intensity; and c) programming the aid to apply the calculated gains.

7. The method of fitting a hearing aid to a user defined in claim 5, the method comprising the steps of:

a) placing a hearing aid on the user in exactly the way it will be worn by the user;

b) setting the hearing aid to the testing/fitting mode with the in-situ testing configuration;

c) having the user participate in a standard hearing test:

d) using the results of the standard hearing test to calculate the amplification parameters for the hearing aid.

8. The method defined in claim 7 wherein the standard hearing test is a threshold hearing level test.

9. The method defined in claim 7, wherein the standard hearing test is the most comfortable hearing level test.

10. The method defined in claim 7, wherein the standard hearing test is the uncomfortable hearing level test.

11. The method defined in claim 10, wherein the in-situ uncomfortable hearing level data are used to derive a level dependent gain response such that the sound at the normal uncomfortable hearing level for normal listeners without the amplification is projected to be perceived at the uncomfortable hearing level for the user with the amplification.

12. The method defined in claim 10, wherein the in-situ uncomfortable hearing level is used to set the maximum gain of the hearing aid.

13. The method defined in claim 12, wherein the maximum gain is set to a value equal to (TH−X), where TH is the in-situ threshold hearing level in ADC units for the user, and X is a constant with a value between 25 and 40.

14. A method of fitting a hearing aid to a user comprising the steps of:

a) placing a programmable hearing aid having a microphone into the ear of the user exactly in the manner the user will wear the hearing aid in everyday use, b) performing at least a threshold hearing level test, c) determining the hearing aid-microphone output during the threshold hearing level test of the aided user with the hearing aid microphone output during a threshold hearing level test with an unaided user to obtain a gain necessary for the aided user to hear sounds like the unaided user, and d) programming the hearing aid, all without the use of earphones, headphones, or loudspeakers.

15. The method defined in claim 14, wherein most comfortable level and uncomfortable level tests are also performed.

16. A hearing aid comprising a microphone, a receiver, and a processor operated in accordance with the method described in claim 1.

17. A hearing aid comprising a microphone, a receiver, and a processor programmed in accordance with the method described in claim 1.

18. A hearing aid comprising a microphone, a receiver, and a processor having a chip programmed in accordance with the method described in claim 1.

19. A non-transitory computer readable medium encoding a program that when executed performs the steps in accordance with the method described in claim 1.

20. The method defined in claim 1 wherein the method-is carried out at each of a range of pre-determined desired frequencies for the user of the hearing aid, making use of the above-determined sensitivity and also of the measured hearing level T obtained through performing a threshold hearing level test, a most comfortable level test and/or an uncomfortable hearing level test at the pre-determined desired frequencies using stimuli internally generated by the hearing aid, the method thereafter being followed by the steps of:

a) deriving hearing aid parameters at least based on the calculated gain values; and b) programming the hearing aid with the said derived hearing aid parameters, all while the hearing aid user is wearing the hearing aid, and without the use of earphones, headphones or loudspeakers.

21. The method recited in claim 20, wherein the stimuli are tones.

22. The method recited in claim 20 wherein the step of calculating gain values includes using the reference levels in the free field of the threshold hearing level, most comfortable hearing level and/or the uncomfortable hearing level for listeners with normal hearing.

23. A method of fitting a hearing aid to a user based on, without the use of earphones, headphones, or loudspeakers, microphone sensitivity and measured hearing level for the user, both in ADC units or its equivalent, the method comprising:

a) for a sound at a particular frequency and level, passing the electrical output of the microphone through an analog to digital converter, and measuring the output of the analog-to-digital converter to obtain a value for output in ADC units to obtain the microphone sensitivity S, whereas ADC referring to analog to digital converter;

b) obtaining the measured value in ADC units of the hearing aid microphone, or its equivalent, at which the hearing level is found for the user at the frequency, herein referred to as T;

c) calculating the gain at the frequency to be used by the hearing aid for the user, as G=T/(SF), where F is the free field referenced sound level in Pascal as required at the hearing level for a normal listener.

24. The method defined in claim 23, further comprising the steps of:

a) obtaining the measured value in ADC units of the hearing aid microphone, or its equivalent, at which the uncomfortable hearing level is found for the user at the frequency, herein referred to as U;

b) calculating another gain at the frequency, to be used by the hearing aid for the user, G=U/(SF), where F is the free field reference sound level in Pascal as required at the uncomfortable hearing level for a normal listener.

25. The method defined in claim 23, further comprising the steps of:

a) obtaining the measured value in ADC units of the hearing aid microphone, or its equivalent, at which the most comfortable level is found for the user at the frequency, herein referred to as M;

b) calculating another gain at the frequency, to be used by the hearing aid for the user, G=M/(SF), where F is the free field reference sound level in Pascal as required at the MCL for a normal listener.

26. The method defined in claim 24, further comprising the steps of:

a) obtaining the measured value in ADC units of the hearing aid microphone, or its equivalent, at which the MCL level is found for the user at the frequency, herein referred to as M;

b) calculating another gain at the frequency, to be used by the hearing aid for the user, as G=M/(SF), where F is the free field reference sound level in Pascal as required at the most comfortable level for a normal listener, and S is the microphone sensitivity.

27. A method of fitting a hearing aid having an amplification processor to a user, the method comprising the steps of:

a) placing the hearing aid on the user's ear exactly the way it will be worn by the user;

b) setting the hearing aid to the in-situ testing/fitting mode with integrated fitting configuration;

c) for a sound at a particular frequency and level, passing the electrical output of the microphone through an analog to digital converter, and measuring the output of the analog to digital converter to obtain a value for output in ADC units to obtain the microphone sensitivity, whereas ADC referring to analog to digital converter;

d) supplying the amplification processor with initial values;

e) normalizing test stimuli in ADC units according to the measured microphone sensitivity and the initial values;

f) determining an additional gain needed for the user to perceive the normalized stimuli at the threshold or uncomfortable hearing level if desired, wherein determining the additional gain is achieved through measuring the user's threshold hearing level, most comfortable hearing level or uncomfortable hearing level according to a predetermined protocol by adjusting a gain parameter of the amplification processor;

g) setting the hearing aid to the normal operation mode; and:

h) applying both the additional gain and the initial values to the amplification processor so that the hearing aid will accurately compensate the users hearing loss.

* * * * *